US008202061B2

(12) United States Patent
Shulver et al.

(10) Patent No.: US 8,202,061 B2
(45) Date of Patent: Jun. 19, 2012

(54) CONTROL SYSTEM AND METHOD FOR PUMP OUTPUT PRESSURE CONTROL

(75) Inventors: David R. Shulver, Richmond Hill (CA); Matthew Williamson, Richmond Hill (CA); Adrian C. Cioc, Ajax (CA)

(73) Assignee: Magna Powertrain Inc., Concord (CA)

( * ) Notice: Subject to any disclaimer, the term of this patent is extended or adjusted under 35 U.S.C. 154(b) by 539 days.

(21) Appl. No.: 12/442,735

(22) PCT Filed: Sep. 26, 2007

(86) PCT No.: PCT/CA2007/001712

§ 371 (c)(1),
(2), (4) Date: Mar. 25, 2009

(87) PCT Pub. No.: WO2008/037070

PCT Pub. Date: Apr. 3, 2008

(65) Prior Publication Data

US 2010/0028171 A1 Feb. 4, 2010

(51) Int. Cl.
*F04B 49/00* (2006.01)

(52) U.S. Cl. ..... 417/216; 417/212; 417/213

(58) Field of Classification Search ..... 417/212–222.2, 417/44.2, 410.3

See application file for complete search history.

(56) References Cited

U.S. PATENT DOCUMENTS

| | | | | |
|---|---|---|---|---|
| 4,236,875 | A * | 12/1980 | Widdowson | 417/222.2 |
| 4,468,173 | A | 8/1984 | Dantlgraber | |
| 4,480,963 | A * | 11/1984 | Ring | 417/216 |
| 4,531,893 | A | 7/1985 | Okoh et al. | |
| 5,800,131 | A | 9/1998 | Lehmann et al. | |
| 6,217,296 | B1 | 4/2001 | Miyazawa et al. | |
| 6,530,752 | B2 | 3/2003 | Oba et al. | |
| 6,688,862 | B2 | 2/2004 | Jeronymo et al. | |
| 6,709,242 | B2 | 3/2004 | Watanabe et al. | |
| 6,790,013 | B2 | 9/2004 | Hunter et al. | |
| 6,896,489 | B2 | 5/2005 | Hunter et al. | |
| 7,018,178 | B2 | 3/2006 | Hunter et al. | |
| 2002/0162537 | A1 * | 11/2002 | Smith et al. | 123/446 |
| 2002/0172610 | A1 * | 11/2002 | Jeronymo et al. | 418/30 |
| 2003/0231965 | A1 * | 12/2003 | Hunter et al. | 417/212 |
| 2005/0100447 | A1 | 5/2005 | Desai et al. | |
| 2006/0104823 | A1 | 5/2006 | Hunter et al. | |
| 2007/0297919 | A1 * | 12/2007 | Szepesy | 417/220 |

FOREIGN PATENT DOCUMENTS

| | | | |
|---|---|---|---|
| WO | 2005026553 | A1 | 3/2005 |
| WO | 2005068838 | A1 | 7/2005 |
| WO | 2006066403 | A1 | 6/2006 |
| WO | 2006129169 | A1 | 12/2006 |

* cited by examiner

*Primary Examiner* — Bumsuk Won

(74) *Attorney, Agent, or Firm* — Harness, Dickey & Pierce, P.L.C.

(57) ABSTRACT

A pump system includes pump having a control feature which, responsive to a supply of pressurized working fluid, reduces the pressure of the working fluid pressurized by the pump. The control feature is connected to the output of the pump by a regulating valve. The control feature receives pressurized working fluid to decrease the output of the pump in response to the pressure of the supplied working fluid. A regulating valve selectively connects the pressurized working fluid to the control feature. The regulating valve has a control port to receive pressurized working fluid from the pump to urge the valve to a closed position against a biasing force. A controllable valve is operable to interrupt the supply of pressurized working fluid to control port to alter the output pressure of the pump.

20 Claims, 6 Drawing Sheets

CONTROL SYSTEM AND METHOD FOR PUMP OUTPUT PRESSURE CONTROL

FIELD OF THE INVENTION

The present invention relates to a system and method for controlling a pump to control the output pressure of the pump. More specifically, the present invention relates to a system and method of controlling a pump to operate at a selectable output pressure, wherein the control system and method will failsafe to provide an output pressure in excess of minimum requirements.

BACKGROUND OF THE INVENTION

Pumps for incompressible fluids, such as oil, are often either gear pumps or vane pumps. In environments such as automotive engine lubrication systems, these pumps will operate over a wide range of speeds, as the engine operating speed changes, resulting in the output volume and the output pressure, as the output of these pumps is generally supplied to a lubrication system which can be modeled as a fixed size orifice, of the pumps changing with their operating speed.

Generally, an engine requires the lubrication oil pressure to increase from a minimum necessary level to a maximum necessary pressure level as the engine operating speed increases, but the maximum necessary oil pressure is generally obtained from the pumps well before the engine reaches its maximum operating speed. Thus, the pumps will provide an oversupply of lubrication oil over a significant portion of the engine operating speed range.

To control this oversupply, and the resulting over pressure which could otherwise damage engine components, constant displacement pumps in such environments are typically provided with a pressure relief valve which allows the undesired portion of the oversupplied oil to return to an oil sump or tank or back to the inlet port of the pump so that only the desired volume, and hence pressure, of fluid is supplied to the engine.

While equipping constant displacement pumps with such pressure relief valves does manage the problems of oversupply at higher operating speeds, there are disadvantages with such systems. For example, the pump is still consuming input energy to pump the oversupply of fluid, even though the pressure relief valve prevents delivery of the undesired portion of the oversupplied fluid, and thus the pump is consuming more engine power than is necessary.

An alternative to constant displacement pumps in such environments is the variable displacement pump, which can be a gear pump or, more commonly a vane pump. Such pumps include a movable control feature, such as the pump ring in vane pumps, which allows the displacement capacity per revolution of the pump to be changed. Typically a control piston, connected to the control feature, is supplied with pressurized oil, directly or indirectly, from the output of the pump and, when the force created by the pressure of the supplied oil on the control piston is sufficient to overcome the force of a biasing spring, the control feature is moved to reduce the displacement of the pump and thus lower the volume and pressure of the pumped oil to a desired level.

If the supplied pressurized oil is at a pressure less than the desired level, then the force generated at the control piston is less than that generated by the biasing spring and the biasing spring will move the control feature to increase the displacement of the pump. In this manner, the output volume (and hence pressure) of the pump can be adjusted to maintain a selected, equilibrium, value of pressure.

While such variable capacity pumps provide advantages over constant capacity pumps and pressure relief valves, it is desirable in some circumstances to further control the displacement of these pumps relative to the speed of the engine, rather than just relative to the output pressure of the pump, thus allowing a designer to change the desired pressure level and/or flow produced by the pump for engine operations at different speeds. Effective displacement control of the pump based at least partially on the operating speed of the engine can result in an improvement in engine efficiency and/or fuel consumption.

While such displacement control is desired, it is also desired that, in the event of a failure of the displacement control system, the system should failsafe such that the engine or other device being supplied by the pump system does not suffer a catastrophic failure. In particular, as a failure of the lubrication oil system can result in catastrophic failure of the engine, it is desired that any speed-related displacement control system must failsafe to prevent damage to the engine.

SUMMARY OF THE INVENTION

It is an object of the present invention to provide a novel failsafe control system and method for controlling the output of a pump system.

According to a first aspect of the present invention, there is provided a pump system for supplying pressurized working fluid to a device with working fluid pressure requirements that vary with the operating speed of the device, the system comprising: a pump operated by the device such that the pump operating speed is dependent upon the device operating speed, the pump including a control feature to decrease the output of the pump in response to pressure applied to the control feature; a regulating valve connecting the output of the pump to the control feature, the regulating valve having a biasing member to bias the regulating valve to a fully opened position and, the regulating valve including: a first chamber to receive pressurized working fluid from the output of the pump to generate a force, corresponding to the output pressure of the pump, which acts against the biasing member to close the valve; and a second chamber to receive pressurized working fluid from the output of the pump to generate a force, corresponding to the output pressure of the pump, the force acting with the force generated in the first chamber to act against the biasing member to close the valve; and a controllable valve to interrupt the supply of pressurized working fluid to the second chamber to alter the output pressure of the pump.

Preferably, the pump is a variable displacement pump.

According to another aspect of the present invention, there is provided a pump system for supplying pressurized working fluid to a device with working fluid pressure requirements that vary with the operating speed of the device, the system comprising: a pump operated by the device such that the pump operating speed is dependent upon the device operating speed, the pump including a first control feature receiving a first supply of pressurized working fluid to decrease the output of the pump in response to the pressure of the supplied working fluid and a second control feature operable to receive a second supply of pressurized working fluid to decrease the output of the pump in response to the pressure of the supplied working fluid; a regulator valve connecting a second supply of pressurized working fluid to the second control feature, the second supply adding to the effect of the first supply, the regulator valve having a biasing member to bias the regulator valve to a fully opened position and having a control port to receive pressurized working fluid from the pump to urge the regulator valve to a closed position against the biasing member force; and a controllable valve to interrupt the supply of pressurized working fluid to the control port to alter the output pressure of the pump.

According to yet another aspect of the present invention, there is provided a pump system for supplying pressurized working fluid to a device with working fluid pressure requirements that vary with the operating speed of the device, the system comprising: a pump operated by the device such that the pump operating speed is dependent upon the device operating speed, the pump including: control feature to alter the displacement of the pump; a biasing member to bias the control feature to a maximum displacement position; a first control chamber to receive working fluid pressurized by the pump to create a force on the control feature to counter the bias of the biasing member to move the control feature toward a minimum displacement position; a second control chamber to receive working fluid pressurized by the pump to create a force on the control feature to counter the bias of the biasing member to move the control feature toward a minimum displacement position; a first regulator valve to supply a regulated amount of pressurized working fluid to the first control chamber to operate the pump system at a first equilibrium output pressure; a second regulator valve to supply a regulated amount of pressurized working fluid to the second control chamber to operate the pump system at a second equilibrium output pressure, the second equilibrium operating pressure being lower than the first equilibrium output pressure; and a regulating valve operable to selectively activate the second regulator valve to change the equilibrium output pressure of the pump system from the first equilibrium output to the second equilibrium output pressure.

The present invention provides a pump system and method for providing pressurized working fluid to a device, the device also driving the pump of the system such that the operating speed of the pump varies with the operating speed of the device and the working fluid requirements of the device change with the operating speed of the device. The pump includes a control feature which, responsive to a supply of pressurized working fluid, reduces the pressure of the working fluid pressurized by the pump. In one embodiment, the control feature is connected to the output of the pump by a regulating valve which is biased to an open position and which includes first and second chambers which can receive pressurized working fluid to create forces which urge the valve closed and the supply of pressurized working fluid to the second chamber can be inhibited by a control device.

The present invention also provides a pump system and method wherein the control feature of the pump receives a first supply of pressurized working fluid to decrease the output of the pump in response to the pressure of the supplied working fluid and a regulating valve connects a second supply of pressurized working fluid to the control feature, the second supply adding to the effect of the first supply. The regulating valve has a biasing member to bias the regulating valve to a fully opened position and the regulating valve has a control port to receive pressurized working fluid from the pump to urge the valve to a closed position against the biasing member force. A controllable valve is operable to interrupt the supply of pressurized working fluid to control port to alter the output pressure of the pump.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
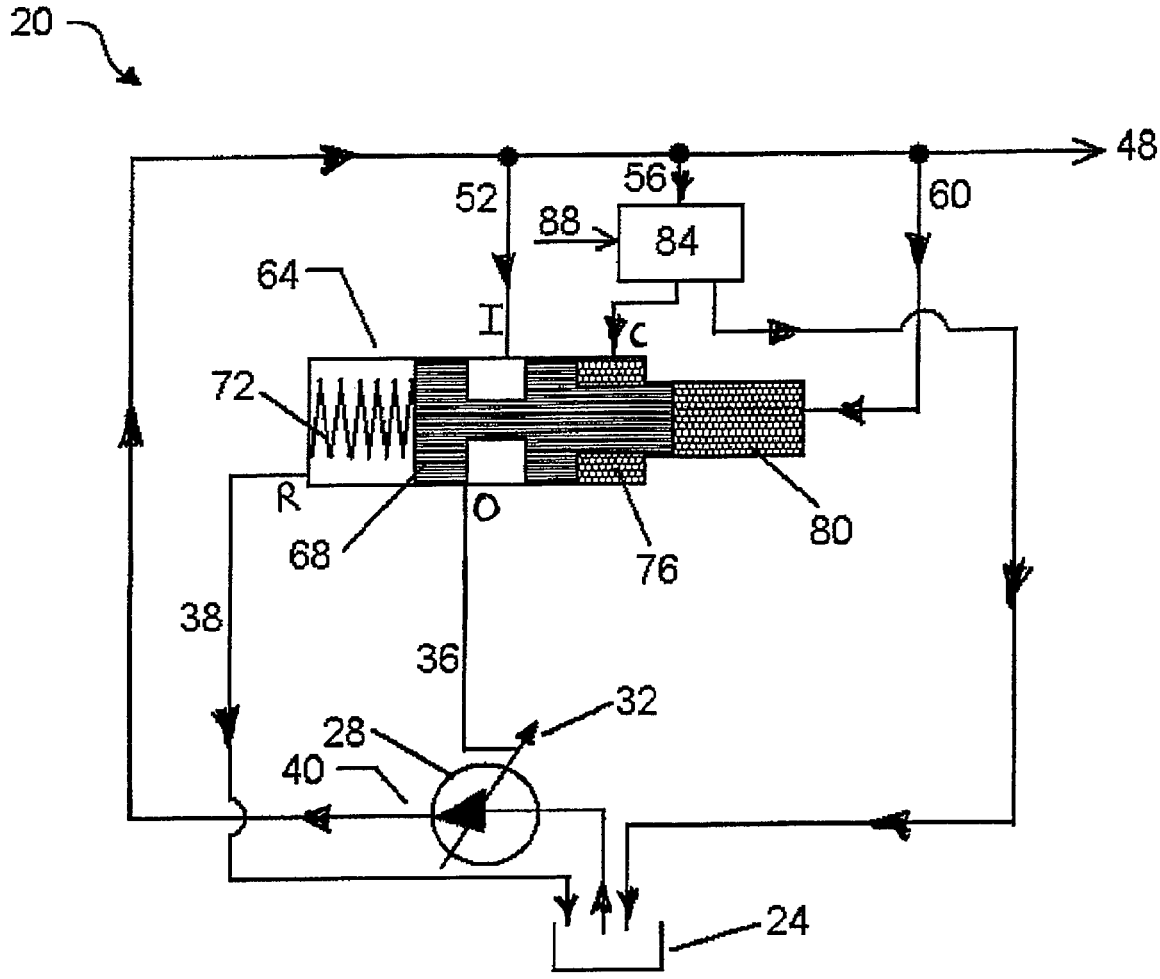
FIG. 1 shows a schematic representation of a pump system in accordance with the present invention.

A pump system with a pressure control system in accordance with the present invention is indicated generally at 20 in FIG. 1. Pump system 20 includes a sump 24 which holds the working fluid to be pumped and a pump 28 to pump working fluid from sump 24.

Pump 28 is preferably a variable displacement pump with a control feature 32 which can alter the displacement of pump 28. However, as will be understood by those of skill in the art, pump 28 can be a fixed displacement pump in which case control feature 32 can be a pressure relief valve whose operating point can be varied as desired.

Control feature 32 responds to the pressure of the working fluid supplied to control feature 32 via a control line 36. As the pressure of the working fluid in control line 36 increases, control feature 32 reduces the volume, and hence the pressure, of the working fluid at the output 40 from pump 28. Conversely, as the pressure of the working fluid supplied to control feature 32 via control line 36 decreases, control feature 32 increases the volume, and hence the pressure, of the working fluid at the output 40 from pump 28.

Output 40 supplies pressurized working fluid to a device 48, such as an engine or other device being supplied with pressurized working fluid, and device 48 also operates pump 28. Thus the operating speed of pump 28 varies with the operating speed of device 48. Pump output 40 also supplies three control feeds 52, 56 and 60, each of which is discussed below.

While in the illustrated embodiment control feeds 52, 56 and 60 are shown as being directly connected to output 40 of pump 28, it will be understood by those of skill in the art that this is not required and, in many circumstances, is in fact not desired.

For example, if device 48 is an internal combustion engine, it is typically desired to control the pressure in an oil gallery of the engine, which may hydraulically be located after one or more filters or other elements of the lubrication system. In such a case at least control feed 60 will be connected to the oil gallery while control feed 52 can be connected to output 40 before or after filters or other components in the hydraulic circuit.

In FIG. 1, control feed 52 connects to the inlet port (I) of a regulator valve. In the embodiments of the present invention illustrated and discussed herein, the form of regulating valve employed is a spool valve but, it should be apparent to those of skill in the art that the present invention is not limited to use with spool valves and any other suitable regulator valve can be employed with the present invention.

In FIG. 1, the inlet port (I) of spool valve 64 connects to the central chamber of spool valve 64 and spool valve 64 includes a movable spool 68 in the central chamber which has a biasing spring 72 acting to bias spool 68 to a first position. Spool valve 64 further includes a first chamber 76 having a control port or inlet port (C) and a second chamber 80 having an inlet. Pressurized working fluid in first chamber 76 will generate a first force on spool 68, acting against the biasing force of biasing spring 72 to move spool 68 from the first position.

Similarly, pressurized working fluid in second chamber 80 will generate a second force on spool 68 acting against the biasing force of biasing spring 72 to move spool 68 from the first position. The forces on spool 68 generated in first chamber 76 and second chamber 80 add together to act against the biasing force of biasing spring 72 and move spool 68 from the first position.

Spool valve 64 provides three modes of operation. In the first mode, where spool 68 is in the first position, control line 36 is connected to sump 24 via line 38 thus applying zero pressure to control feature 32 and allowing fluid to flow out of control feature 32 as necessary for pump 28 to operate at its maximum output.

In the second mode, spool 68 is been moved against biasing spring 72, by forces generated in either or both of first chamber 76 and second chamber 80, to a second position where control line 36 is isolated by spool 68. Thus fluid in control feature 32 is hydraulically locked in at a pressure, and control feature 32 is not able to alter the output of pump 28 (other than by leakage of fluid from control feature 32).

In the third mode, spool 68 is moved to a third position by forces generated in either or both of first chamber 76 and second chamber 80. In this position control line 36 is connected to supply line 52, thus pressurized fluid is applied to control feature 32 which reduces the output of pump.

Second chamber 80 of spool valve 64 is supplied with pressurized working fluid from control feed 60. First chamber 76 is connected to control feed 56 via a controller comprising an electrically controllable valve 84 responsive to an electronic control signal 88. Valve 84 can be a solenoid operated ON/OFF type valve, or in a presently preferred embodiment, valve 84 is an electronically controlled proportional valve which provides an electrically adjustable pressure drop across valve 84.

In the embodiment wherein valve 84 is an ON/OFF valve, one of two equilibrium pressures can be selected for pump 24. In the preferred embodiment, where valve 84 is a proportional valve, by selecting and modulating an appropriate pressure drop across valve 84, any equilibrium operating pressure can be selected for pump system 20, as desired.

To provide a failsafe functionality, the effective pressurized areas of second chamber 80 and first chamber 76 of spool valve 64 are selected such that, under the action of pressurized working fluid in second chamber 80 alone, pump output 40 will reach a first equilibrium pressure which is sufficiently high to meet the requirements of device 48 under worst case conditions and, under the action of pressurized working fluid acting together in both second chamber 80 and first chamber 76, pump output 40 will assume a second equilibrium pressure higher than the first. When pump 24 is a variable displacement pump, second equilibrium pressure requires less energy to achieve, but in any case the second equilibrium pressure will meet the requirements of device 48 under certain operating conditions.

Control valve 84 is responsive to electrical control signal 88 which can be produced by an Engine Control Unit (ECU) or other suitable control device. In the case of an ON/OFF type valve, valve 84 connects first chamber 76 either to pressurized working fluid from control line 56 or to sump 24, via return line 38.

In the more preferred embodiment wherein valve 84 is an electronically controlled proportional valve, electrical control signal 88 selects and modulates the working fluid pressure supplied to first control chamber 76 from between zero pressure and the pressure of pump output 40.

As should now be apparent to those of skill in the art, pump system 20 allows for the output pressure of pump 28 to be varied in response to control signal 88 which can be a speed-related or any other control parameter. In the case of a speed-related parameter, as the speed of device 48 increases, an appropriate control signal 88 is provided to valve 84 which interrupts and decreases the amount of working fluid supplied to, or removes working fluid from, first chamber 76.

An increase in the supply of working fluid to first chamber 76 increases the force created therein which acts against biasing spring 72. When this increased force, in combination with the force created in second chamber 80 is sufficient to move spool 68 from the first position, against the biasing force of biasing spring 72, working fluid is supplied from control feed 52 to control line 36, and thus to control feature 32, and the output 40 of pump 28 is reduced.

Thus, pump system 20 allows for the operation of pump system 20 at an appropriate output level for all expected operating conditions of device 48 and avoiding the oversupply of working fluid at conditions wherein pump 28 is operating at low speeds.

However, in addition to the ability to control the output of pump 28 to avoid oversupply of working fluid, pump system 20 includes a failsafe operating mode which ensures an adequate pressurize of working fluid for device 48 even in the event of a failure of valve 84 or control signal 88.

Specifically, if the supply of working fluid to first chamber 76 is interrupted due to failure of valve 84 or control signal 88, the working fluid in second chamber 80, which is directly supplied from control feed 60, will generate sufficient force on spool 68 against the biasing force of biasing spring 72 such that the output of pump 28 will still be limited, albeit at a higher limit than would otherwise be the case.

Figure 2:
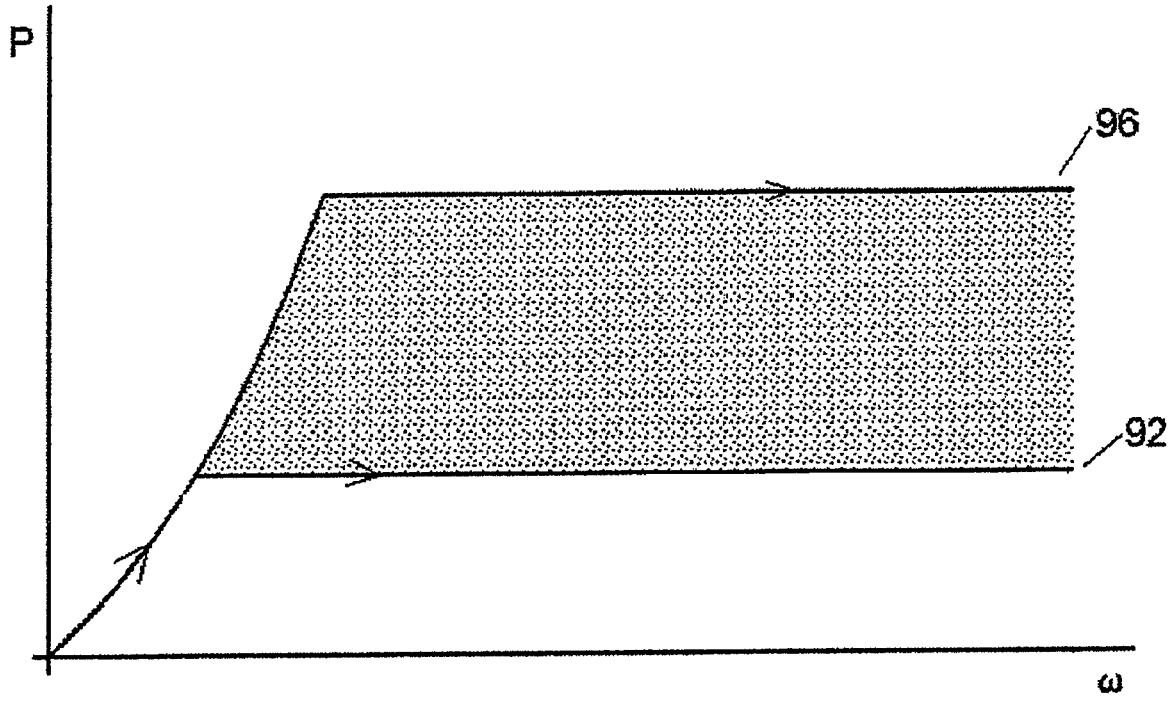
FIG. 2 shows a plot of the output of the pump of the pump system of FIG. 1 with a nominal operating curve and a failsafe operating curve.

FIG. 2 shows one example plot of the output pressure P of pump 28 versus the operating speed ω of device 48. Curve 92 shows the lowest safe limit for the equilibrium pressure output of pump 28 when system 20 is operating at lower rotational speeds of device 48, while curve 96 shows a higher equilibrium pressure for when device 48 is operating at higher rotational speeds. This higher equilibrium pressure is also the failsafe pressure that will be produced in the event of a failure of valve 88, control feed 56 or control signal 88.

During normal operation of device 48, in the case where valve 88 is an ON/OFF valve, valve 88 will be switched on at lower speeds and output 40 will follow lower curve 92. At higher speeds, as determined by the designer of pump system 20 in view of the requirements of device 48, valve 88 will be switched off and output 40 will increase and follow upper curve 96.

During normal operation of device 48, in the case where valve 88 is a proportional valve, the output of pump 28 will be within the shaded area between curves 92 and 96 at the particular points selected by the designer of device 48 by designing control signal 88.

Figure 3:
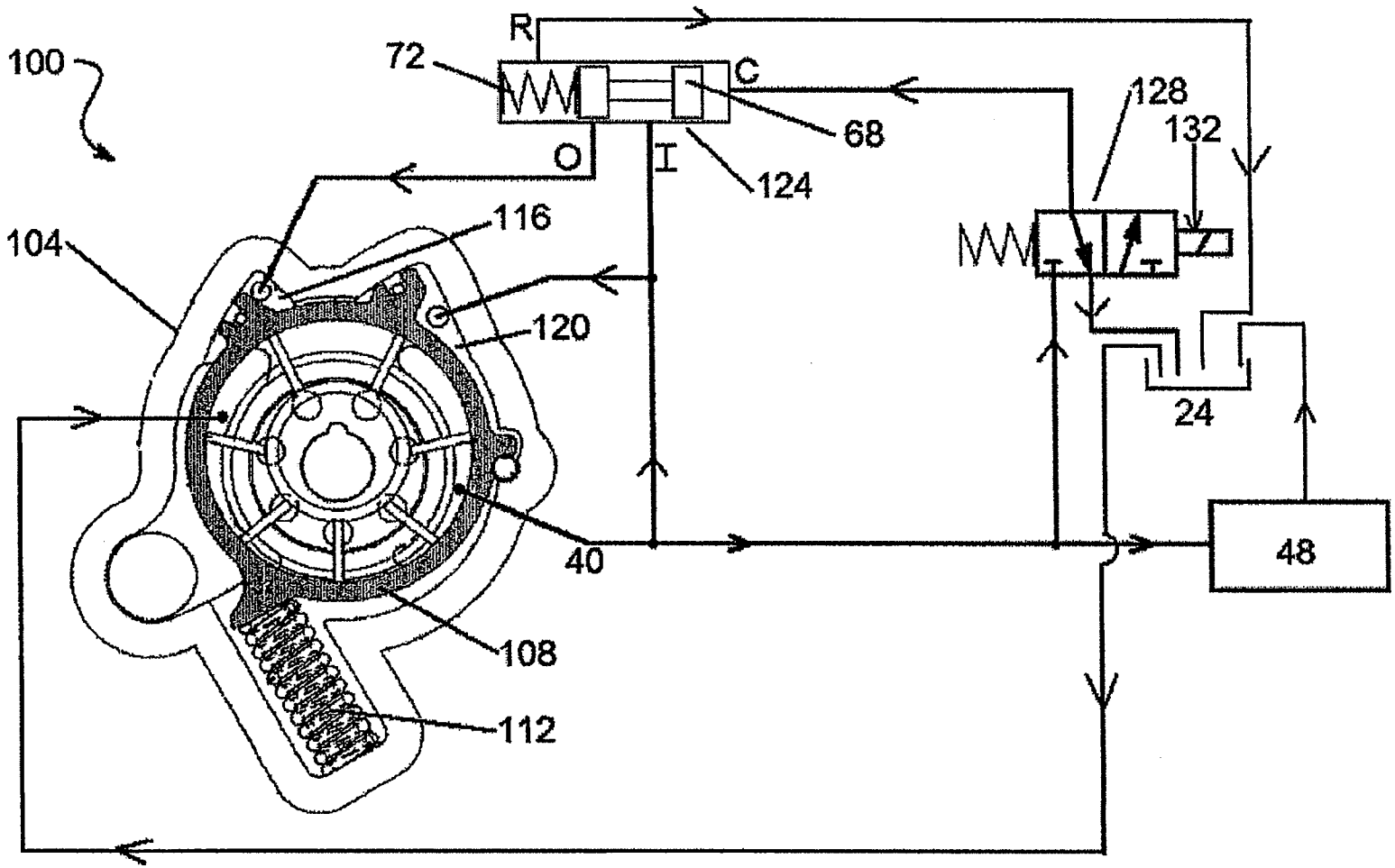
FIG. 3 shows another pump system in accordance with the present invention.

Another pump system in accordance with the present invention is indicated generally at 100 in FIG. 3. In this embodiment, wherein similar components to those of the embodiment of FIG. 1 are indicated with like reference numerals, pump 104 is a variable displacement pump. Pump 104 includes a control feature wherein pressurized working fluid can be separately supplied to each of two different control feature components to create separate forces which act on the control feature. These created forces act to move the control feature to reduce the displacement of pump 104 and a biasing force, such as provided by a biasing spring, acts against these forces to move the control feature to a position of maximum displacement.

A specific example of such a pump 104 is the variable displacement vane pump disclosed in PCT application WO 06/066403.

In the example illustrated in FIG. 3, wherein pump 104 is the above-mentioned variable displacement vane pump, the control feature is a pump control ring 108. Pump control ring 108 is biased to the position corresponding to maximum displacement of the pump by a biasing spring 112. Pump 104 also includes a second control chamber 116 and a first control chamber 120 each of which, when supplied with pressurized working fluid, create forces on control ring 108 which act against the force of biasing spring 112 to move the pump control ring 108 towards a position corresponding to minimum displacement of the pump.

In a similar fashion to pump system 20, discussed above, output 40 from pump 104 provides pressurized working fluid to device 48. Output 40 also provides pressurized working fluid to: first control chamber 120; the input port (I) of a spool valve 124; and to a controller comprising an electrically controlled valve 128. Again, while in the illustrated embodiment the regulator valve is a spool valve, the present invention is not so limited and any suitable regulator valve, as will occur to those of skill in the art, can be employed.

In the illustrated embodiment, valve 128 is an ON/OFF type valve but it will be apparent to those of skill in the art that valve 128 can also be an electrically controlled proportional valve, such as that described above with reference to FIG. 1.

Control valve 128 operates to selectively supply pressurized working fluid from output 40 to the control port (C) of spool valve 124 to change the equilibrium operating pressure of pump system 100 responsive to an electrical control signal 132, from an ECU or other suitable control device.

Specifically, when de-energized, control valve 128 connects the control port (C) of spool valve 124 to sump 24 and a relatively high equilibrium pressure is established for pump output 40 by the force on pump control ring 108 from biasing spring 112 and the counter force created in first chamber 120 by the pressurized working fluid from pump output 40.

Conversely, when energized, control valve 128 connects and opens control port (C) of spool valve 124 to pressurized working fluid from pump output 40 and spool valve 124 is responsive to the biasing force of biasing spring 72 and the counter force produced by the pressurized working fluid supplied to its control port (C) to vary the position of spool 68 between the first, second and third positions of spool 68. Specifically, biasing spring 72 and the control chamber of spool valve 124 are designed/selected such that spool 68 is in the second position, isolating outlet port (O) and second control chamber 116 when a desired value of pressure is applied at control port (C) to establish pump output 40 at a second, lower, equilibrium pressure.

If pump output pressure 40 exceeds the second equilibrium pressure, the higher pressure at control port (C) moves spool valve 68 from the second position to the third position to connect outlet port (O) to inlet port (I) thus connecting second control chamber 116 to pressurized working fluid from pump output 40. The pressurized working fluid in second chamber 116 creates a force on pump control ring 108 which adds to the force created by the pressurized working fluid in first control chamber 120 to move pump control ring 108 against biasing spring 112 to reduce the displacement of pump 104 to reduce pump output 40 to the second equilibrium pressure. Once pump output 40 reaches the second equilibrium pressure, the reduced pressure at control port (C) allows spool 68 to return to the second position.

If pump output pressure 40 is less than the second equilibrium pressure, the lower pressure at control port (C) allows the spool valve 68 to move from the second position to the first position to connect outlet port (O) to return port (R) thus connecting second control chamber 116 to sump 24. The removal of pressurized working fluid from second chamber 116 reduces the force on pump control ring 108 to only that created by the pressurized working fluid in first control chamber 120, and pump control ring 108 is moved by biasing spring 112 to increase the displacement of pump 104 to increase pump output 40 to the second equilibrium pressure. Once pump output 40 reaches the second equilibrium pressure, the increased pressure at control port (C) allows spool 68 to return to the second position.

First control chamber 120 is constructed such that, under the action of pressurized working fluid supplied to the first control chamber 120 alone, pump output 40 will reach a first equilibrium pressure sufficiently high to meet the requirements of device 48 under worst case conditions. Thus, pump system 100 will operate in a failsafe mode in the event of a failure of spool valve 124 or valve 128.

It is contemplated that, when device 48 is operating at lower speeds, valve 128 will be energized resulting in output 40 being at the second equilibrium pressure to provide an energy savings.

Figure 4:
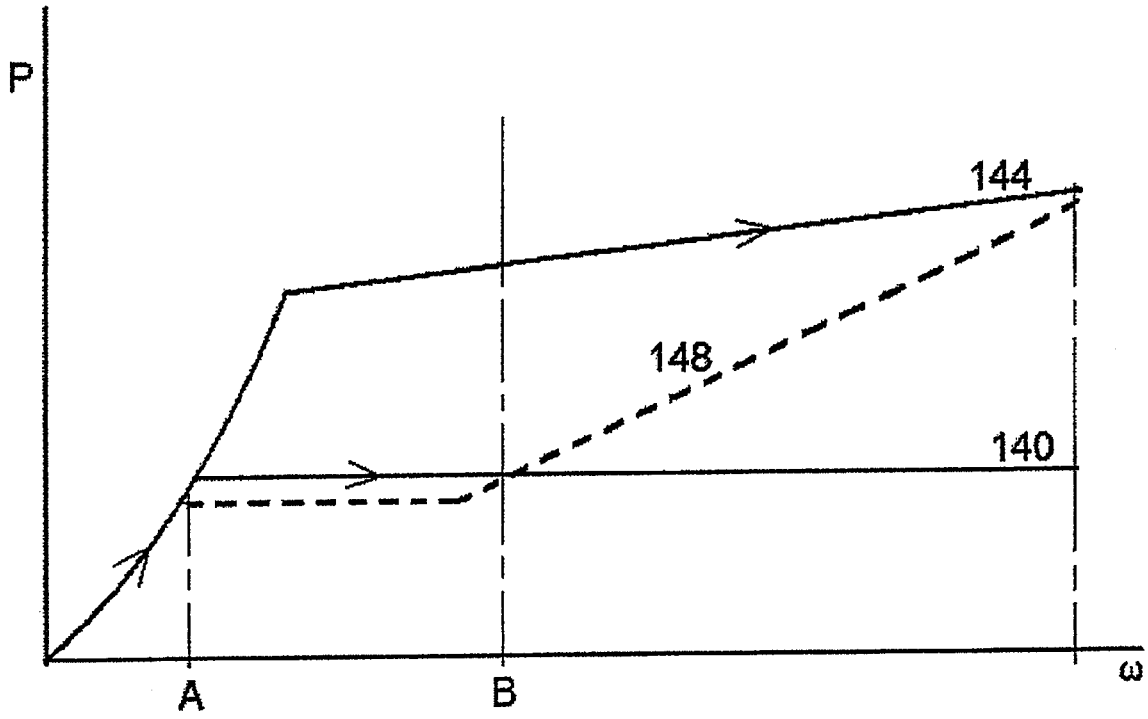
FIG. 4 shows a plot of the output of the pump of the pump system of FIG. 3 with a nominal operating curve and a failsafe operating curve.

FIG. 4 shows a plot of the output pressure of pump system 100 versus the operating speed of device 48, and hence the operating speed ω of pump 104. Curve 140 shows the second equilibrium output pressure of pump 104 when valve 128 is energized, connecting output 40 to control port (C).

As shown, with valve 128 energized, the output pressure initially increases with the speed of device 48 as spool 68 in spool valve 124 is in the first position an no pressurized working fluid is in second control chamber 116. At this point, as the pressure applied to the control port (C) of spool valve 124 generates sufficient force to overcome the force of the biasing spring 72 in spool valve 124, spool 68 is moved to the second position and pressurized working fluid is supplied to second control chamber 116. The force created in second control chamber 116 adds to the force created in first control chamber 120 and moves pump control ring 108 against biasing spring 112 to reduce the displacement of pump 104 to maintain the second equilibrium pressure, despite the increase in operating speed of pump 104.

Biasing spring 72 and the pressurized working fluid supplied to control port (C) of spool valve 124 now function to move spool 68 between the first, second and third positions to maintain the necessary pressure of working fluid in second control chamber 116 to maintain pump output 40 at the second equilibrium operating pressure.

Curve 144 shows the first equilibrium output pressure of pump 104 when valve 128 is de-energized, or if valve 128 has failed. As shown, the second equilibrium output pressure is higher than curve 140 as the only regulating force is that exerted on pump control ring 108 by first chamber 120. As will be apparent to those of skill in the art, curve 144 has a characteristic which rises with speed ω as a result of the increasing force of biasing spring 112 which results as pump control ring 108 moves towards the minimum pump displacement position resulting in the compressed length of biasing spring 112 being reduced.

Curve 148 shows an example of lubrication pressure requirements for device 48. In this example, device 48 is an internal combustion engine and speed "A" represents the engine operating at an idle speed. In this example, the engine is equipped with variable valve timing and such engines often benefit from a constant lubrication oil pressure, which they use to control the camshaft phasors.

Therefore, as illustrated, between speeds "A" and "B", the desired lubrication oil pressure will be constant and, after speed "B", the lubrication oil pressure requirements will increase more or less linearly until device 48 reaches its maximum speed.

Accordingly, it is contemplated that in normal operations, solenoid 128 will be energized between idling of device 48 and speed "B" so that the output pressure of pump 104 will follow curve 140. Above speed "B", solenoid 128 will be de-energized so that the output pressure of pump 104 will increase to follow curve 144, exceeding the increasing requirements of device 48.

As will also be apparent to those of skill in the art, in the event of an electrical failure of valve 128, or the control circuitry providing signal 132 to it, pump system 100 operates in a failsafe mode, following curve 144, to prevent damage to device 48, albeit at the cost of an oversupply of working fluid.

Figure 5:
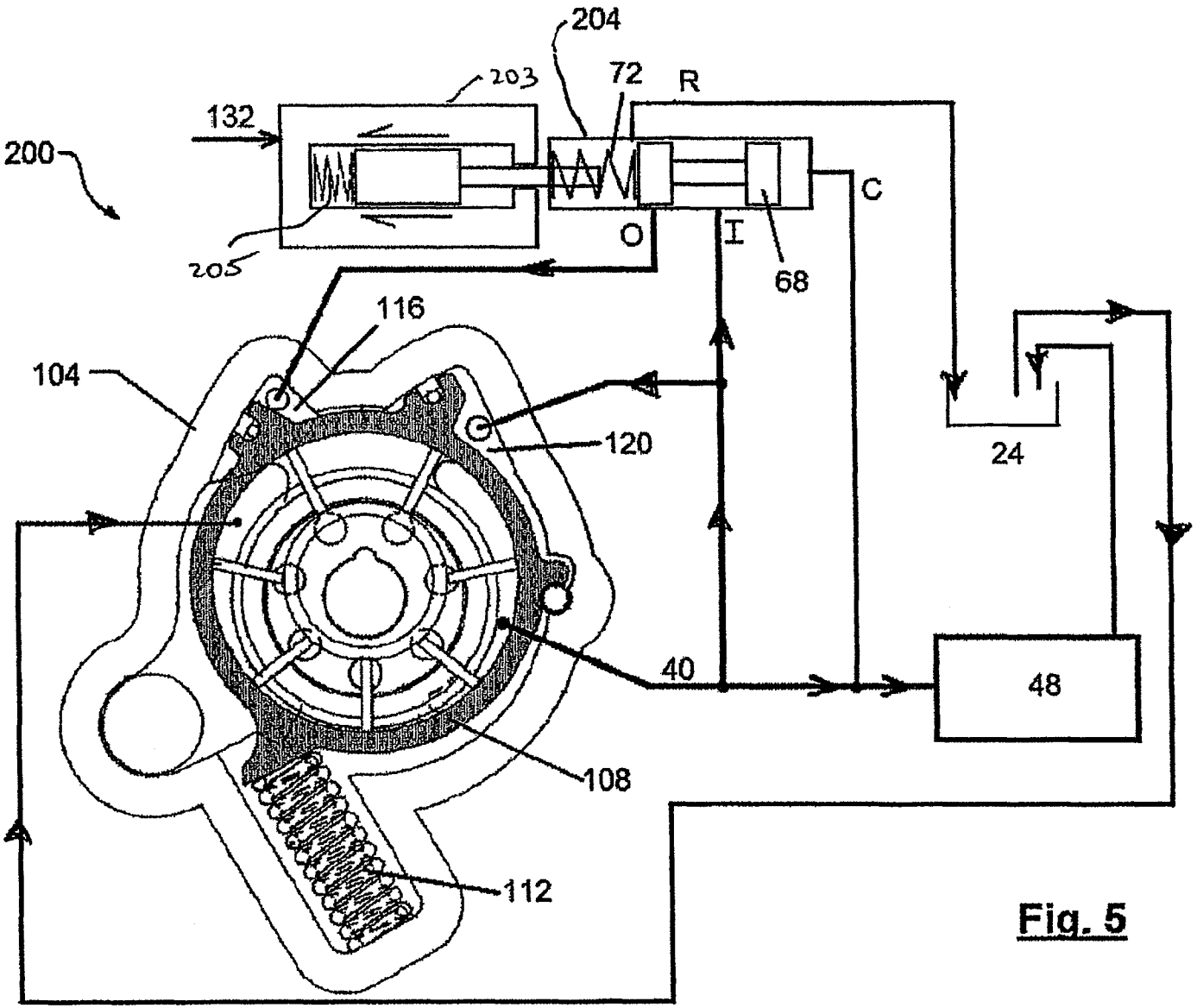
FIG. 5 shows another pump system in accordance with the present invention.

FIG. 5 shows another pump system 200 in accordance with the present invention wherein like components to those of FIG. 3 are indicated with like reference numerals. In this embodiment, instead of a controller to control the connection of output 40 to control port C of spool valve 124, the controller is a solenoid 203 combined with spool valve 204. Solenoid 203 and spool valve 204 operate such that, when the solenoid 203 is energized by control signal 132, spool 68 is free to move in response to the pressure of the working fluid supplied to control port C and pump system 200 will operate at the lower second equilibrium operating pressure of curve 140 of FIG. 4.

Conversely, when the solenoid 203 is de-energized by removing control signal 132, the internal spring 205 inside the solenoid 203 forces spool 68 to the first position, closing inlet port (C) interrupting the fluid communication with the output 40, connecting output port (O) and hence second control chamber 116 to sump 24. In this configuration, pump system 200 will operate at the higher first equilibrium pressure of curve 144 of FIG. 4.

One contemplated advantage of pump system 200 over pump system 100 is a contemplated reduction in the cost of pump system 200 compared to pump system 100.

Figure 6:
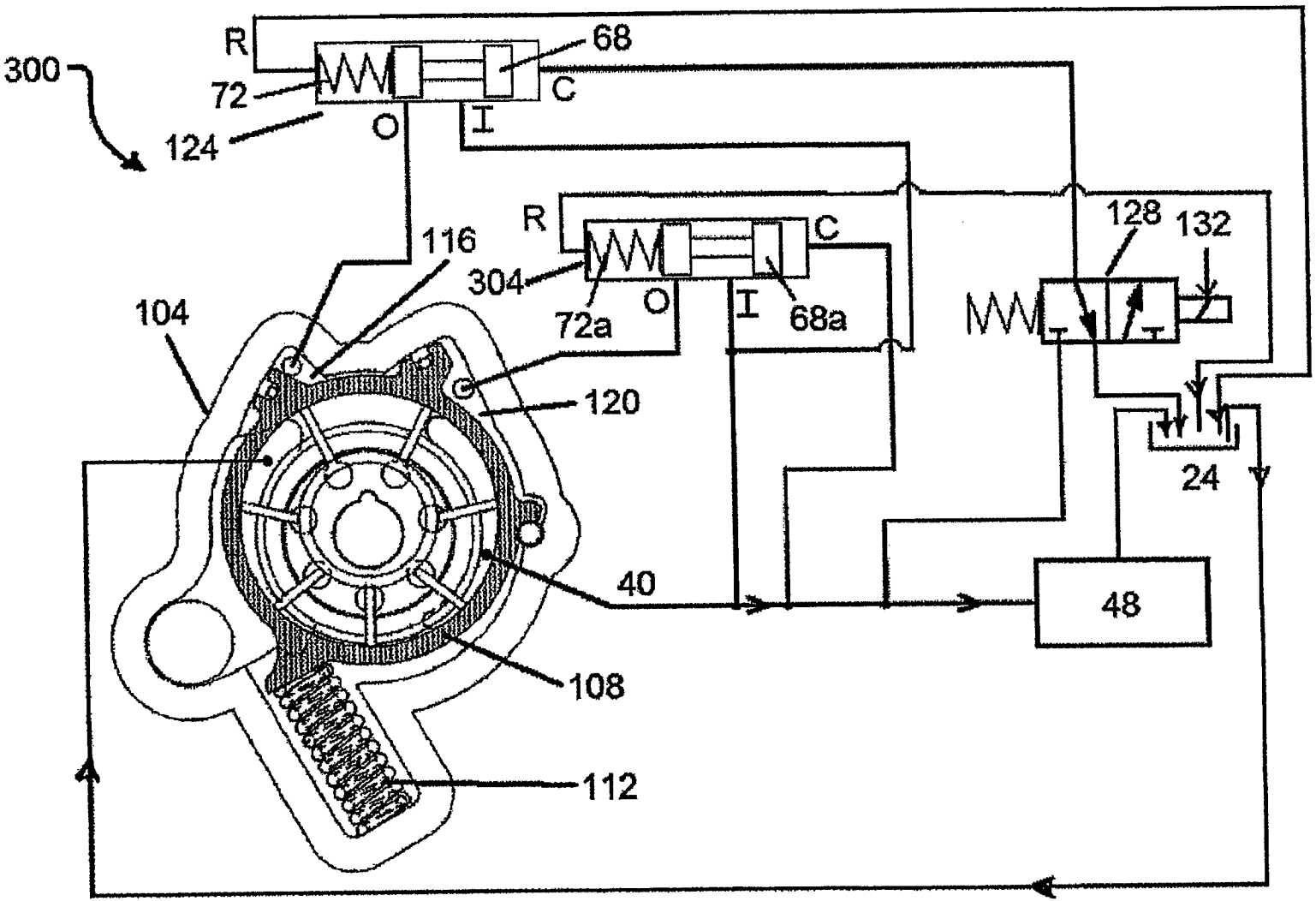
FIG. 6 shows another pump system in accordance with the present invention.

FIG. 6 shows yet another pump system 300 in accordance with the present invention wherein like components to those of FIG. 3 are indicated with like reference numerals. In pump system 300, the supply of pressurized working fluid to second control chamber 120 is controlled by a second regulator valve, in this example second spool valve 304, whose control port (C) is connected, either directly or indirectly, to pump output 40.

Second spool valve 304 operates in a similar manner to spool valve 124 of FIG. 3 to establish an equilibrium pressure at pump outlet port 40 by introducing and removing pressurized working fluid to second control chamber 120 to move control ring 108 as needed. Spool 68*a* moves, under the influence of biasing spring 72*a* and the pressure of working fluid at its control port (C), between the first, second and third positions discussed above.

When valve 128 (which is an ON/OFF type valve) is de-energized, spool 68 of spool valve 124 is in the first position and second control chamber 116 is connected to sump 24. Thus, in this condition, second spool valve 304 and first control chamber 120 performs the regulation of pump output pressure to the second equilibrium pressure, which pressure is defined by biasing spring 72*a*, biasing spring 112 and the effective area of second control chamber 120. This second equilibrium pressure is sufficient to meet the needs of device 48 under worst case operating conditions.

When valve 128 is energized by control signal 132, pressurized working fluid from pump outlet port 40 is supplied to control port (C) of spool valve 124. As biasing spring 72 of spool valve 124 is selected to regulate pump output 40 at a lower equilibrium pressure than the above-mentioned second equilibrium pressure, the pressurized working fluid supplied to control port (C) of spool valve 124 immediately moves spool 68 to the third position wherein pressurized working fluid from its inlet port port (I) is provided to its outlet port port (O) and thus to first control chamber 116.

The force on pump control ring 108 created in first control chamber 116 moves pump control ring 108 to reduce the displacement of pump 104 so that the pressure of pump output 40 reduces to the first equilibrium pressure. As the pressure of pump outlet port 40 decreases from the second equilibrium pressure to the first equilibrium pressure, the pressure of the working fluid at control port (C) of second spool valve 304 is reduced and spool 68*a* returns to the first position connecting second control chamber 120 to sump 24.

As should now be apparent to those of skill in the art, in pump system 300 regulation of the pressure of pump output 40 at the second (higher) equilibrium output pressure is performed by second spool valve 304 which controls second control chamber 120. Conversely, regulation of the pressure of pump output 40 at the first (lower) equilibrium output pressure is performed by spool valve 124 which controls first control chamber 116.

As should also now be apparent, in the event of a failure of valve 128 or control signal 132, pump system 300 will operate at the second equilibrium pressure, providing a failsafe operation for device 48.

Finally, as should also now be apparent to those of skill in the art, pump system 300 provides for substantially flat equilibrium operating pressure characteristics, similar to those shown in FIG. 2, without requiring the use of an electrically controllable proportional valve.

The present invention provides a pump system and method for providing pressurized working fluid to a device, the device also driving the pump of the system such that the operating speed of the pump varies with the operating speed of the device and the working fluid requirements of the device change with the operating speed of the device. The pump includes a control feature which, responsive to a supply of pressurized working fluid, reduces the pressure of the working fluid pressurized by the pump. In one embodiment, the control feature is connected to the output of the pump by a regulating valve which is biased to an open position and which includes first and second chambers which can receive pressurized working fluid to create forces which urge the valve closed and the supply of pressurized working fluid to the second chamber can be inhibited by a control device.

In another embodiment, the control feature of the pump receives a first supply of pressurized working fluid to decrease the output of the pump in response to the pressure of the supplied working fluid and a regulating valve connects a second supply of pressurized working fluid to the control feature, the second supply adding to the effect of the first supply. The regulating valve has a biasing member to bias the regulating valve to a fully opened position and the regulating valve has a control port to receive pressurized working fluid from the pump to urge the valve to a closed position against the biasing member force. A controllable valve is operable to interrupt the supply of pressurized working fluid to control port to alter the output pressure of the pump.

The above-described embodiments of the invention are intended to be examples of the present invention and alterations and modifications may be effected thereto, by those of skill in the art, without departing from the scope of the invention which is defined solely by the claims appended hereto.

What is claimed is:

1. A pump system for supplying pressurized working fluid to a device with working fluid pressure requirements that vary with the operating speed of the device, the system comprising:

a pump operated by the device such that the pump operating speed is dependent upon the device operating speed, the pump including a control feature regulating an output pressure of the pump;

a regulating valve having a first inlet port and a second inlet port in fluid communication with an output of the pump, a first outlet port in fluid communication with a reservoir of working fluid and a second outlet port in fluid communication with the control feature of said pump, said regulating valve having a reciprocating spool that moves in response to pump operating speed to selectively open and close fluid communication of the first inlet port and the second outlet port, said regulating valve biased to close fluid communication between said first inlet port and the second outlet port and open fluid communication between said first and second outlet ports, wherein the regulating valve includes:

a first chamber in fluid communication with the second inlet port selectively receiving pressurized working fluid from the output of the pump to generate a first force corresponding to the output pressure of the pump, which urges the spool to move against the bias; and a second chamber selectively receiving pressurized working fluid from the output of the pump to generate a second force corresponding to the output pressure of the pump, the second force acting with the first force generated in the first chamber to move the spool against the bias; and a controller operable to interrupt fluid communication of the second inlet port to alter output pressure of the pump between a first equilibrium pressure and a higher second equilibrium pressure.

2. The pump system of claim 1 wherein the controller is a controllable valve in fluid communication with the output of the pump and the second inlet port, said controllable valve enabling pressurized working fluid to responsively effect movement of said spool.

3. The pump system of claim 2 wherein the pump is a variable displacement pump and the control feature alters the displacement of the pump.

4. The pump system of claim 3 wherein the control feature comprises a control chamber in the pump receiving pressurized working fluid from the second outlet port of the regulating valve, said pressurized working fluid acting on a biased and movable pump control ring.

5. The pump system of claim 3 wherein the control feature comprises a first control chamber in the pump receiving pressurized working fluid from the second outlet port of the regulating valve and a second control chamber in the pump receiving pressurized working fluid from the output of the pump, said pressurized working fluid in each of said control chambers acting on a biased and movable pump control ring.

6. The pump system of 3 wherein the controllable valve is an ON/OFF valve that is responsive to an electrical control signal.

7. The pump system of claim 3 wherein the controllable valve is a proportional valve that is responsive to an electrical control signal.

8. The pump system of claim 1 wherein the control feature is a pressure relief valve.

9. The pump system of claim 1 wherein the controller is a biased solenoid operatively engaging said spool, said solenoid responsive to an electric control signal to urge the regulating valve to close fluid communication at the second inlet port and between said first inlet port and the second outlet port and open fluid communication between said first and second outlet ports.

10. The pump system of claim 9 wherein the control feature comprises a first control chamber in the pump receiving pressurized working fluid from the second outlet port of the regulating valve and a second control chamber in the pump receiving pressurized working fluid from the output of the pump, said pressurized working fluid in each of said control chambers acting on a biased and movable pump control ring.

11. A pump system for supplying pressurized working fluid to a device with working fluid pressure requirements that vary with the operating speed of the device, the system comprising:

a pump operated by the device such that the pump operating speed is dependent upon the device operating speed, the pump including a control feature regulating an output pressure of the pump;

a regulating valve having a first inlet port and a second inlet port in fluid communication with an output of the pump, a first outlet port in fluid communication with a reservoir of working fluid and a second outlet port in fluid communication with the control feature of said pump, said regulating valve having a reciprocating spool that moves in response to pump operating speed to selectively open and close fluid communication of the first inlet port and the second outlet port, said regulating valve biased to close fluid communication between said first inlet port and the second outlet port and open fluid communication between said first and second outlet ports; and a controller operable to interrupt fluid communication of the second inlet port to alter output pressure of the pump between a first equilibrium pressure and a higher second equilibrium pressure, wherein the controller is a controllable valve in fluid communication with the output of the pump and the second inlet port, said controllable valve enabling pressurized working fluid to responsively effect movement of said spool, wherein the pump is a variable displacement pump and the control feature alters the displacement of the pump, and further wherein the control feature comprises a first control chamber and a second control chamber, said first control chamber receiving pressurized working fluid from the second outlet port of the regulating valve and said pump system further comprising a second regulating valve having a first inlet port and a second inlet port, both in fluid communication with the output of the pump, a first outlet port in fluid communication with a reservoir of working fluid and a second outlet port in fluid communication with the second control chamber, said second regulating valve having a reciprocating spool that moves in response to pressure at said second inlet port to selectively open and close fluid communication of the first inlet port and the second outlet port, said second regulating valve biased to close fluid communication between said first inlet port and the second outlet port and open fluid communication between said first and second outlet ports, said pressurized working fluid in each of said control chambers acting on a biased and movable pump control ring.

12. A pump system for supplying pressurized working fluid to a device with working fluid pressure requirements that vary with the operating speed of the device, the system comprising:

a pump operated by the device such that the pump operating speed is dependent upon the device operating speed, the pump including:

a control feature to alter the displacement of the pump;

a biasing member to bias the control feature to a maximum displacement position;

a first control chamber to receive working fluid pressurized by the pump to create a force on the control feature to counter the bias of the biasing member to move the control feature toward a minimum displacement position;

a second control chamber to receive working fluid pressurized by the pump to create a force on the control feature to counter the bias of the biasing member to move the control feature toward a minimum displacement position;

a first regulator valve to supply a regulated amount of pressurized working fluid to the first control chamber, wherein the first regulator valve includes:

a first chamber in receipt of pressurized working fluid from the pump to generate a first force corresponding to the output pressure of the pump, which urges a valve member to move against a bias; and a second chamber in receipt of pressurized working fluid from the pump to generate a second force corresponding to the output pressure of the pump, the second force acting with the first force generated in the first chamber to move the valve member against the bias; and a controller operable to selectively activate the first regulator valve to change the equilibrium output pressure of the pump system between a first equilibrium output pressure and a higher second equilibrium output pressure.

13. The pump system of claim 12 wherein the controller is a valve.

14. The pump system of claim 13 wherein the valve is an ON/OFF valve that is responsive to an electrical control signal.

15. The pump system of claim 13 wherein the valve is a proportional valve that is responsive to an electrical control signal.

16. The pump system of claim 13 wherein the pump system further comprises a second regulator valve to supply a regulated amount of pressurized working fluid to the second control chamber.

17. The pump system of claim 16 wherein the controllable valve is an ON/OFF valve that is responsive to an electrical control signal.

18. The pump system of claim 16 wherein the controllable valve is a proportional valve that is responsive to an electrical control signal.

19. The pump system of claim 12 wherein the controller is an electro-mechanical ON/OFF solenoid that is responsive to an electrical control signal.

20. The pump system of claim 12 wherein the controller is an electro-mechanical proportional solenoid that is responsive to an electrical control signal.

* * * * *

UNITED STATES PATENT AND TRADEMARK OFFICE

CERTIFICATE OF CORRECTION

PATENT NO. : 8,202,061 B2
APPLICATION NO. : 12/442735
DATED : June 19, 2012
INVENTOR(S) : David R. Shulver et al.

It is certified that error appears in the above-identified patent and that said Letters Patent is hereby corrected as shown below:

In the Title Page:

Please add Item (60) --Related U.S. Application Data

(60) Provisional Application No. 60/847,238 filed on September 26, 2006.--

Signed and Sealed this
Fourth Day of September, 2012

David J. Kappos

David J. Kappos
*Director of the United States Patent and Trademark Office*